US005189980A

United States Patent [19]

Zirkelbach et al.

[11] Patent Number: 5,189,980

[45] Date of Patent: * Mar. 2, 1993

[54] ROUNDED TOP HEADER EXTRUSION FOR BOAT WINDSHIELDS

[75] Inventors: Albert W. Zirkelbach; Alan P. Zirkelbach; Donald A. Zirkelbach, all of Sarasota, Fla.

[73] Assignee: Aldon Industries Inc., Bradenton, Fla.

[ * ] Notice: The portion of the term of this patent subsequent to Feb. 19, 2008 has been disclaimed.

[21] Appl. No.: 639,347

[22] Filed: Jan. 10, 1991

Related U.S. Application Data

[62] Division of Ser. No. 409,655, Sep. 19, 1989, Pat. No. 4,993,351.

[51] Int. Cl.[5] ..... B63B 17/00

[52] U.S. Cl. ..... 114/361

[58] Field of Search ..... 114/343, 361; 52/397, 52/400, 208, 211; 296/84.1, 136, 96.21

[56] References Cited

U.S. PATENT DOCUMENTS

| | | | |
|---|---|---|---|
| 2,937,652 | 5/1960 | Zimmer, Jr. et al. | 114/361 X |
| 3,172,419 | 3/1965 | Lewis | 114/361 X |
| 4,993,351 | 2/1991 | Zirkelbach et al. | 114/361 |

OTHER PUBLICATIONS

William L. Bonnell Company, Inc., Diagram of an Extrusion, Aug. 3, 1987, Die No. ADN-17.

*Primary Examiner*—Edwin L. Swinehart
*Attorney, Agent, or Firm*—Dykema Gossett

[57] ABSTRACT

A rounded top header extrusion for boat windshields being constructed as a unitary extruded member for rigidly engaging a boat windshield. The extrusion provides a curved upper surface for supporting a boat canopy, and a recessed channel extending inwardly into the extrusion for receiving a fastener or similar article for attachment of a boat canopy. The extrusion is defined in cross-section by a pair of generally parallel arms forming a windshield engaging channel, and a generally semi-circular rail portion extending across the channel between the arms.

8 Claims, 2 Drawing Sheets

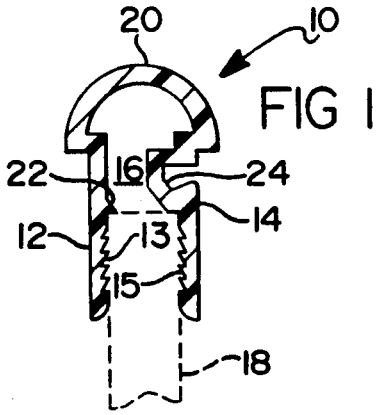
FIG 1
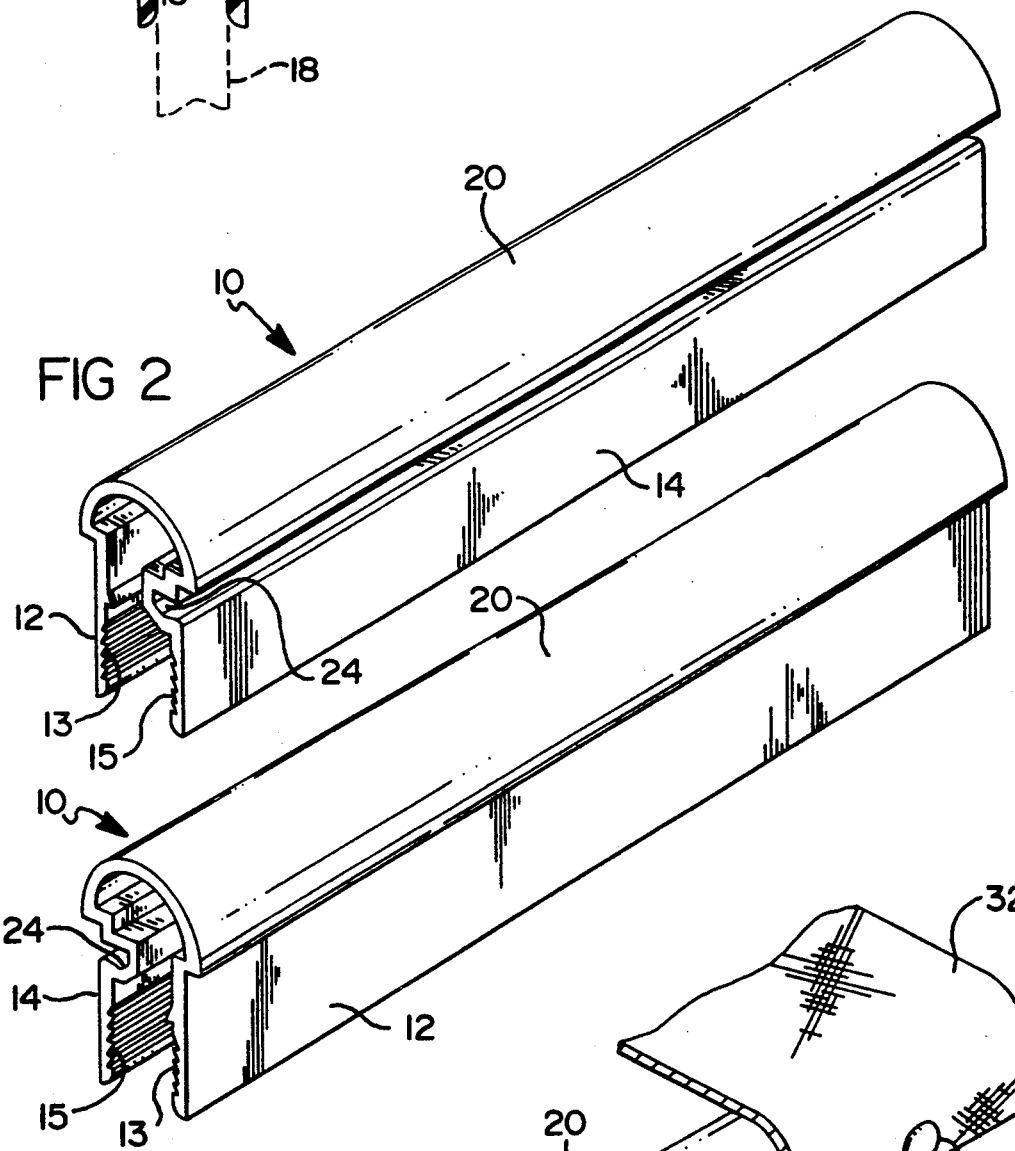
FIG 2
FIG 3
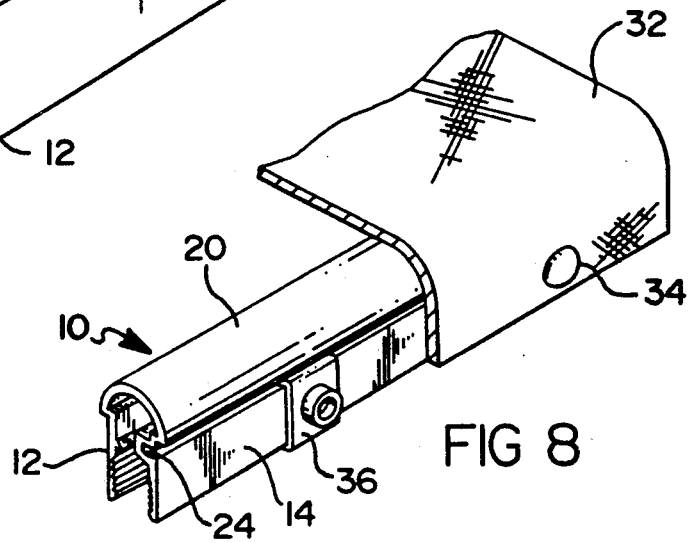
FIG 8

ROUNDED TOP HEADER EXTRUSION FOR BOAT WINDSHIELDS

This is a division of application Ser. No. 07/409,655 filed Sep. 19, 1989, now U.S. Pat. No. 4,993,351, Feb. 19, 1991.

BACKGROUND OF THE INVENTION

1. Field of the Invention

The present invention relates to boat windshield assemblies, and particularly to the extrusions utilized to finish the top of the windshield and from time to time permit the attachment of a boat canopy or similar top.

2. Description of the Prior Art

There are a variety of techniques described in the prior art for providing an extruded metal finishing header across the top of a boat windshield, which header frequently includes means for attaching a boat canopy or other type of top. By way of example Lewis in U.S. Pat. No. 3,172,419 discloses a generally rectangular shaped channel formed on the underside of an aluminum extrusion to fit over the upper extremity of the windshield, the channel being provided with on the inner sides to grip the edges of the glass and further including a flexible locking strip for attachment to the boat canopy. A similar technique is disclosed by Muhlberger in U.S. Pat. No. 4,750,449, with an aluminum mounting member contoured to receive the lower edge of the windshield and having a lower portion of semicircular section intended to secure the member to the deck of the boat. A vinyl liner is used by Muhlberger between the windshield and the channel of the member. Fasteners are installed into the space between the semicircular section and the base to secure the member to the deck. See also U.S. Pat. No. 3,093,844 to Brock et al.

McGee in U.S. Pat. No. 2,961,725 and Zimmer et al. in U.S. Pat. No. 2,937,652 disclose other windshield-canopy finishing arrangements. See also U.S. Pat. No. 3,416,282 to Daugherty.

SUMMARY OF THE INVENTION

The present invention is directed to a unitary extruded member for rigidly engaging a boat windshield and providing a curved upper surface with means for supporting a boat canopy, the extruded member comprising an elongated extrusion having a generally uniform cross-section along its length. The extrusion is defined in cross-section by a pair of generally parallel arms having a windshield-engaging channel between them for receiving the boat windshield and with each arm having means along the channel for gripping the windshield. A generally semi-circular rail portion extends across the channel between the arms, and means are provided within the plane of the channel for permitting engagement of a boat canopy to the extrusion.

In the preferred embodiment, the extrusion comprises stop means along the channel for engaging the extremity of the boat windshield short of the rail portion thereby permitting the rail portion to extend beyond the extremity of the windshield. It is further preferred that the canopy engagement means comprise a recessed channel extending inwardly into the extrusion, which channel extends from the outside surface of one of the arms and generally lateral to the direction of the windshield-engaging channel between the pair of arms. This recessed channel is positioned in the one arm adjacent the rail portion, and forms a stop along the one arm for the extremity of the windshield.

When the extrusion of the present invention is joined with a boat windshield pane, the lateral channel of the extrusion extends into the longitudinal channel engaging the windshield but in the plane of the windshield pane for receiving means for engaging the canopy fitted across the passenger area of the boat.

BRIEF DESCRIPTION OF THE DRAWINGS

FIG. 1 is a cross-sectional elevation of the extrusion of the present invention, and with an upper extremity of the windshield which extends into the extrusion being shown in dotted lines;

FIG. 2 is a side perspective view illustrating the extrusion of FIG. 1;

FIG. 3 is a perspective view of the side opposite the side shown in FIG. 2;

FIG. 8 is a perspective view illustrating the manner in which the extrusion of the present invention is utilized to attach a boat canopy to the boat windshield.

DETAILED DESCRIPTION OF THE PREFERRED EMBODIMENT

Figure 4:
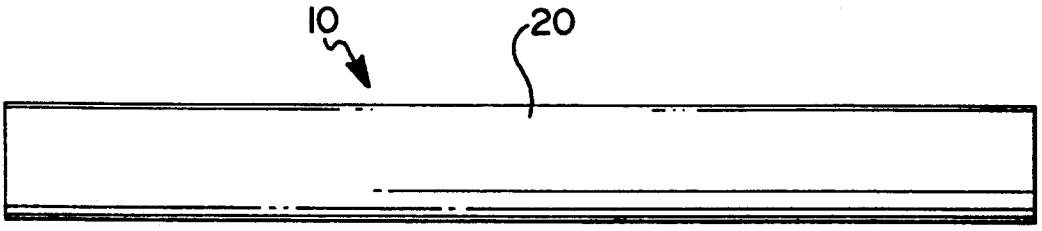
FIG. 4 is a top plan view of the extrusion of FIG. 1.
Figure 5:
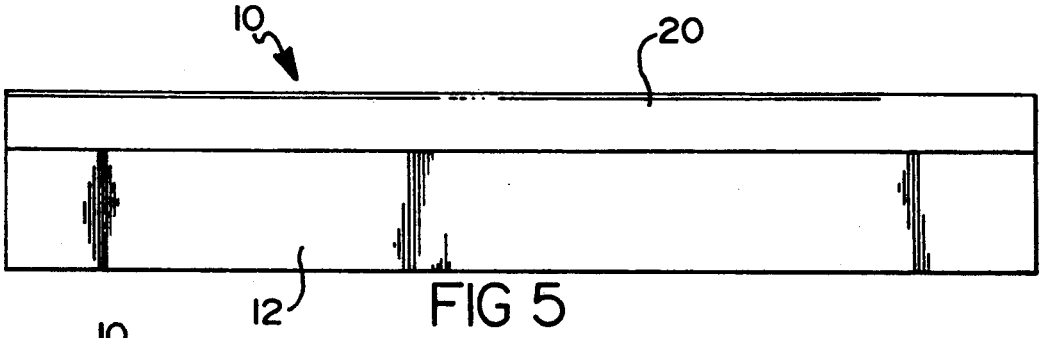
FIG. 5 is a side elevation of the side shown in the perspective view of FIG. 3.
Figure 6:
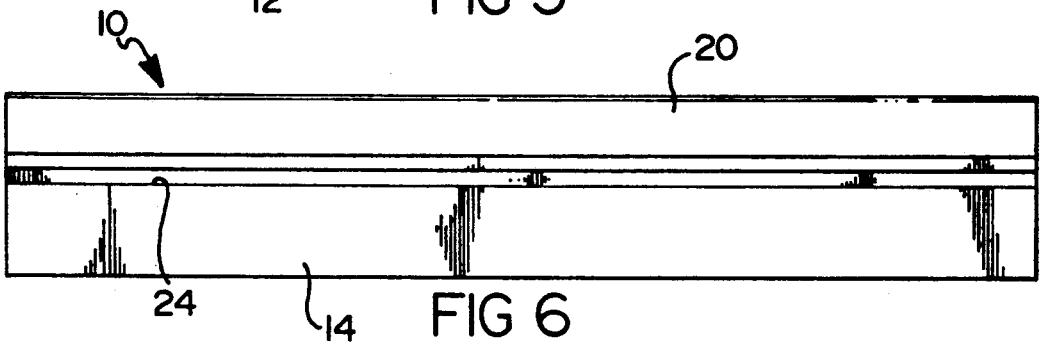
FIG. 6 is a side elevation of the side shown in the perspective view of FIG. 2.

The extrusion for a windshield header in accordance with the present invention will be described with reference to FIGS. 1–6. The extrusion, referred to generally by the reference numeral 10, includes a pair of generally parallel arms 12, 14 having a channel 16 between them for receiving the upper extremity of the boat windshield 18 (shown in dotted lines) and with each arm 12, 14 having serrations 13, 15 along the respective inside surface of each for gripping the windshield 18.

The extrusion further includes a semi-circular rounded rail portion extending between the two sides, and which is slightly offset outwardly with respect to each side, as shown in cross-section in FIG. 1. One of the arms 12 includes an inside stop 22, while the other arm 14 includes a channel 24 extending laterally into the channel 16, which channel 24 will be understood to extend into the plane of the windshield 18. Thus, the lateral channel 24 forms a stop along the one arm 14 for the extremity of the windshield 18. Further, however, the lateral channel 24 provides means for attaching a fastener or similar article for attachment of a boat canopy or the like, as is described in detail below with respect to FIG. 8. It will be noted in FIG. 1 that the channel 24 lies within the plane of the windshield 18, and does not extend outside of the extrusion 10, thus providing a streamlined construction.

Figure 7:
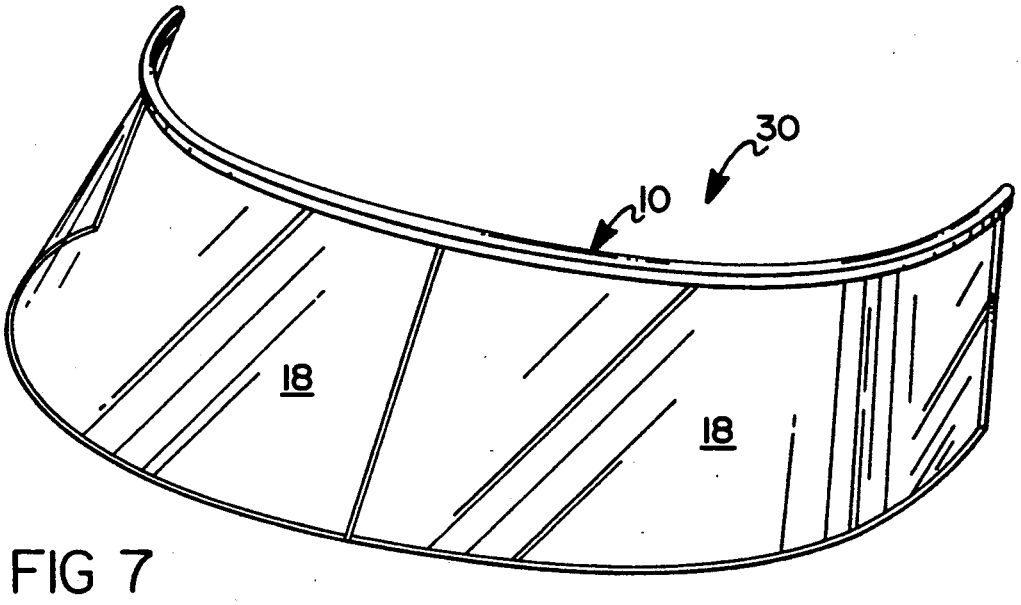
FIG. 7 is a front view of a boat windshield utilizing the extrusion of the present invention.

As is shown in FIG. 7, the extrusion 10 may be fitted across the top of a boat windshield 30 having a pair of windshield panes 18; and as is further shown in FIG. 8, the extrusion 10 may be utilized with fasteners 34, 36 to attach a boat canopy 32 which extends across the passenger compartment of the boat, and is then joined to the header 10 in the manner shown.

It will be understood that various modifications may be employed with the extrusion and boat windshield shown and described above, without departing from the spirit and scope of the present invention.

What is claimed is:

1. A unitary member for rigidly engaging a boat windshield having an extremity, providing a curved upper surface and providing means for supporting a boat canopy, the member comprising an elongated extrusion having a generally uniform cross-section along its length, the extrusion being defined in cross-section by:

first and second generally parallel arms having a windshield-engaging channel between them for receiving the boat windshield and the extremity, each arm having means along the channel for gripping the windshield;

a generally semi-circular rail portion extending across the channel between the arms; and means for permitting engagement of a boat canopy to the extrusion comprising:

(a) a lateral channel extending inward into the extrusion and being formed by the first arm; and (b) a fastener extending generally from said windshield-engaging channel and terminating adjacent the lateral channel, said fastener being adapted to mate with the canopy.

2. The unitary member recited in claim 1 wherein the extrusion further comprises stop means along the channel for engaging the extremity of a boat windshield short of the rail portion, thereby permitting the rail portion to extend beyond the extremity of the windshield.

3. The unitary member as recited in claim 1 wherein the extrusion is formed by the first arm between the extremity of the boat windshield when engaged, and the rail portion.

4. The member as recited in claim 3 wherein the surface of the windshield extremity forms a plane, and wherein said rail portion is disposed completely on one side of said plane.

5. A unitary member for rigidly engaging a boat windshield, providing a curved upper surface and providing means for supporting a boat canopy, the member comprising an elongated extrusion having a generally uniform cross-section along its length, the extrusion being defined in cross-section by:

(a) pair of generally parallel arms having a windshield-engaging channel between them for receiving the boat windshield and with each arm having means along the channel for gripping the windshield;

(b) a generally semi-circular rail portion across the channel between the arms; and (c) means within at least one plane of the windshield for permitting engagement of a boat canopy to the extrusion, the permitting means comprising a recessed channel extending inwardly into the extrusion, the recessed channel extending from the outward surface from one of the arms and generally lateral to the direction of the windshield engaging-channel, the recessed channel being positioned in one of the arms adjacent the rail portion and forming a stop along one arm for the extremity of a windshield engaged in the windshield-engaging channel.

6. A member for engaging a boat windshield for supporting a boat canopy comprising:

an elongated extrusion being defined in cross sections by:

(a) first and second parallel arms having a windshield engaging channel between them for receiving the boat windshield with an extremity, each arm having means along the channel for gripping the windshield;

(b) a generally semi-circular rail portion extending across the channel between the arms;

(c) a lateral channel being formed by the first arm and extending into said extrusion; and a fastener being adapted to engage the boat canopy, said fastener extending generally from the windshield engaging channel and terminating within said lateral channel.

7. The member as recited in claim 6 wherein said extrusion extends between the rail portion and the extremity of the boat windshield when received.

8. The member as recited in claim 7 wherein the inner surface of the first arm forms a plane parallel to the surface of the windshield, and wherein said channel extends into the plane.

* * * * *